US005903932A

United States Patent [19]

Whitesel

[11] Patent Number: 5,903,932

[45] Date of Patent: May 18, 1999

[54] PORTABLE TOILET WITH DISPOSABLE LINER

[76] Inventor: Mary Jennifer Whitesel, 5021 Florence Ave. Apt. #2, Downers Grove, Ill. 60515

[21] Appl. No.: 08/911,345

[22] Filed: Aug. 14, 1997

[51] Int. Cl.[6] ..... A47K 11/00

[52] U.S. Cl. ..... 4/476; 4/484

[58] Field of Search ..... 4/476, 483, 484

[56] References Cited

U.S. PATENT DOCUMENTS

| | | | |
|---|---|---|---|
| 8,462 | 10/1851 | Willmot | 4/483 X |
| 56,870 | 7/1866 | Alvord | 4/483 X |
| 541,219 | 6/1895 | Weston | 4/483 X |
| 3,381,315 | 5/1968 | Glassberg | 4/484 |
| 4,807,308 | 2/1989 | Person et al. | 4/483 |
| 5,170,516 | 12/1992 | Davison | 4/484 |
| 5,354,132 | 10/1994 | Young et al. | 4/144.2 X |
| 5,415,475 | 5/1995 | Sandy | 4/484 X |

*Primary Examiner*—Robert M. Fetsuga
*Attorney, Agent, or Firm*—Laff, Whitesel, Conte & Saret, Ltd.

[57] ABSTRACT

A portable toilet seat, especially—but not exclusively for a child, has a cup shape and is arranged to receive a liner. The liner is a film of hydrophobic material with a drainage pad attached to the center thereof. The seat is preferably a closed container when not in use. Storage space may be included with in the closed container

11 Claims, 2 Drawing Sheets

PORTABLE TOILET WITH DISPOSABLE LINER

This invention relates to portable toilets with disposable liners, especially for toddlers and young children, and more particularly to portable toilets having general use for any time when such toilets would be useful, as when camping, for example.

Toilet training is one of the most formidable tasks in child rearing. In the toilet training chairs available today, the child eliminates waste directly into a plastic basis. Usually, the contents are then dumped in to conventional toilet coupled to home plumbing, for example. Then the training toilet must be cleaned.

Another difficult part of toilet training is centered on what to do when away from home. Young children, even those who have been successfully toilet trained, will usually tell the parent of their need with only moments to spare before the event. Often the parent either finds public toilet to be less than desirable or can not find one.

While baby equipment includes such things as disposable diapers, portable toilet seats, and the like, there has been no easy way of cleaning a portable toilet after is it was used, especially in a non-home environment.

Yet another consideration is what a parent wants and how much he is willing to pay for such an appliance. If the parent want compactness, the smallest possible size is important. If the parent wants a completely self contained appliance, storage compartments may be more important than compactness. Still other consideration is cost. Some parents want the lowest possible cost. Others want a status symbol.

Another consideration for making this invention is to provide a single design which can be made in different sizes. In the youth or adult sizes, the toilet may be used during camping, at locations with no active plumbing, and the like. There are today portable toilets with chemicals, but they require cleaning, require handling the liquid of the chemical, and are not always suitable.

Accordingly, an object of the invention is to provide a way of making toilet training easier. Another object is to make cleaning it almost as easy as using disposable diapers. Still another object is to provide a structure of a conventional toilet with of the convenience of a disposable diaper.

Yet another object of the invention is to provide a completely self contained portable device which may be sealed and carried safely. Here an object is to provide a design which can be adapted to compactness, self-contained completeness, cost variations and the like.

Still another object is to provide a design which may be made in many sizes and adapted for many uses.

In keeping with an aspect of the invention, preferably, a three part plastic device includes a cup shaped base unit, a lid, and a center section. The base unit and the lid snap on over the center section to provide a completely closed container. The space under the center section and within the base unit and the space within the lid provides room for personal items. The center section is a receptacle for receiving and supporting a liner which may be discarded after use. To give optional variations, the base unit may be eliminated to make a more compact unit. Also, to give compactness, the storage compartments may be eliminated.

The invention may be best under stood from the following specification taken with the appended drawings, in which.

Figure 1:
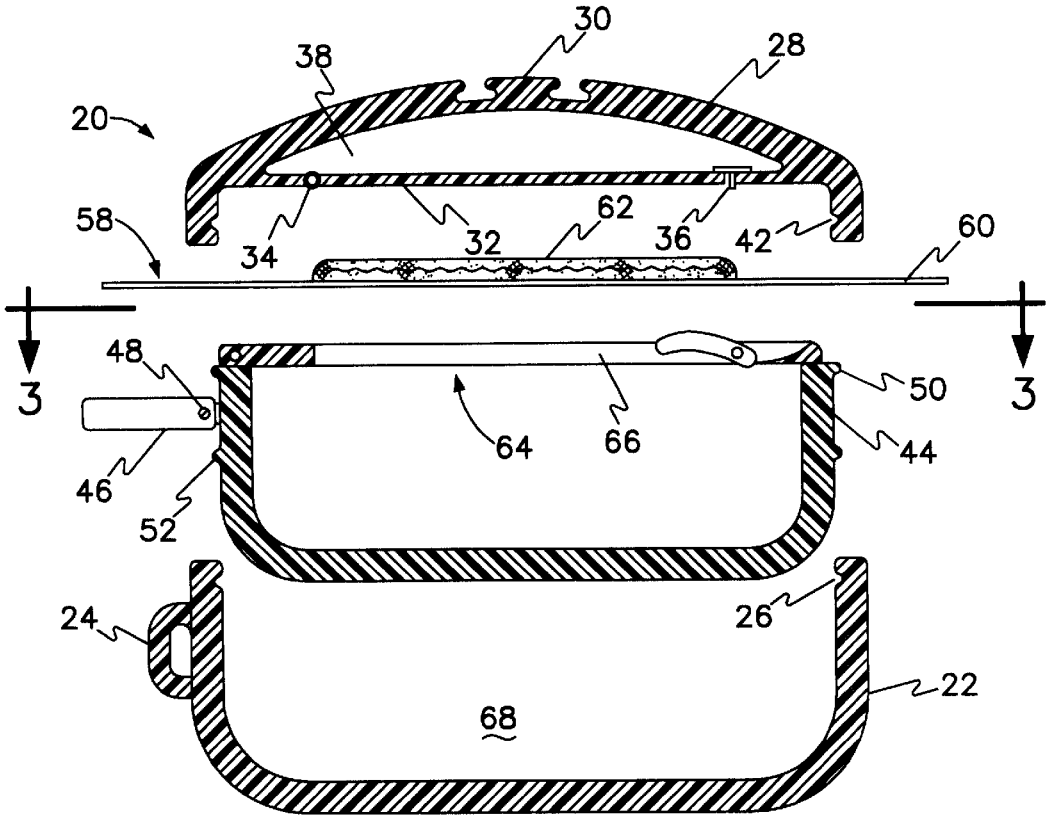
FIG. 1 is a cross-section view of the preferred three piece device which forms the toilet seat.

The inventive device 20 is a three piece arrangement preferably made of molded plastic. The base unit 22 is generally cup shaped with a handle 24 on one side. A snap coupler recess 26 is formed around the inside perimeter of the base unit 22 and near the upper rim or edge thereof.

The lid 28 has a recessed handle 30 in the top surface which facilitates lifting it without introducing any protrusion which may interfere with carrying or stacking things on top of it. Inside the lid, an inner door 32 is hinged at 34 and latched at 36 to form a closed container 38 which may be used as a storage compartment for fresh liners and which may be used to carry some personal items. A recess 42 is formed around the inside perimeter of the lid.

The center section 44 is also cup shaped. A handle 46, preferably hinged at 48, extends outwardly from the center section. A pair of vertically disposed snap coupler peripheral beads 50 and 52 extend outwardly from the center section 44. Each of the beads has a contour which snaps into a corresponding one of the recesses 42 and 26 in the lid and base unit, respectively.

Therefore, when the two beads 50, 52 are snapped into the recesses 42 and 26, the device 20 is a completely closed container. The lid 28 maybe removed by lifting the know 30 with one hand while the other hand is holding the handle 46. Likewise, the center section 44 may be removed from the base unit 22 by holding the handle 24 while lifting the handle 46.

Figure 2:
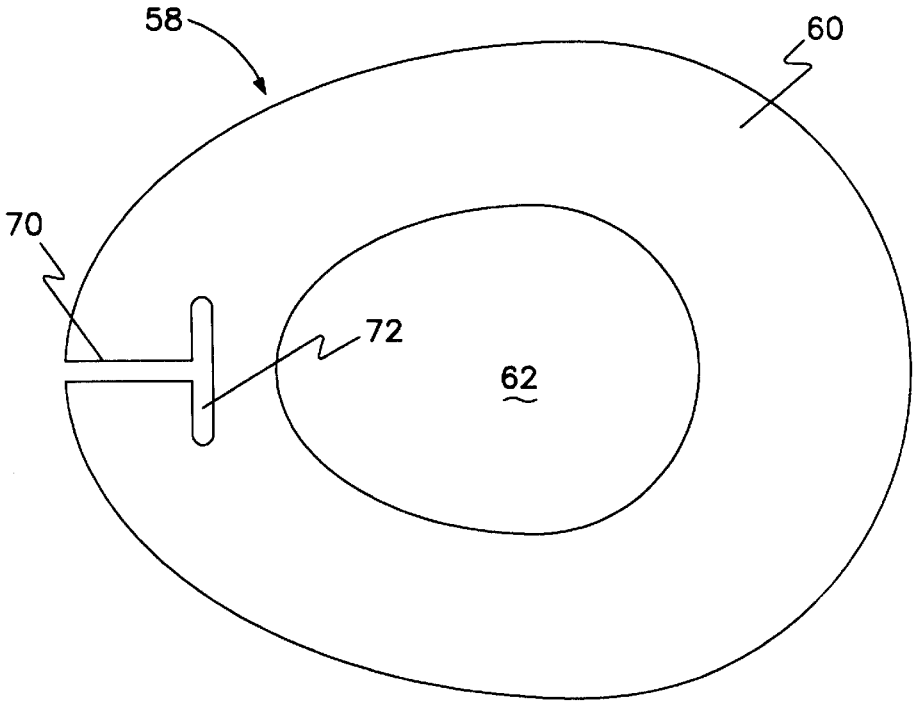
FIG. 2 is a plan view of a liner used within the center section of the device of FIG. 1.
Figure 3:
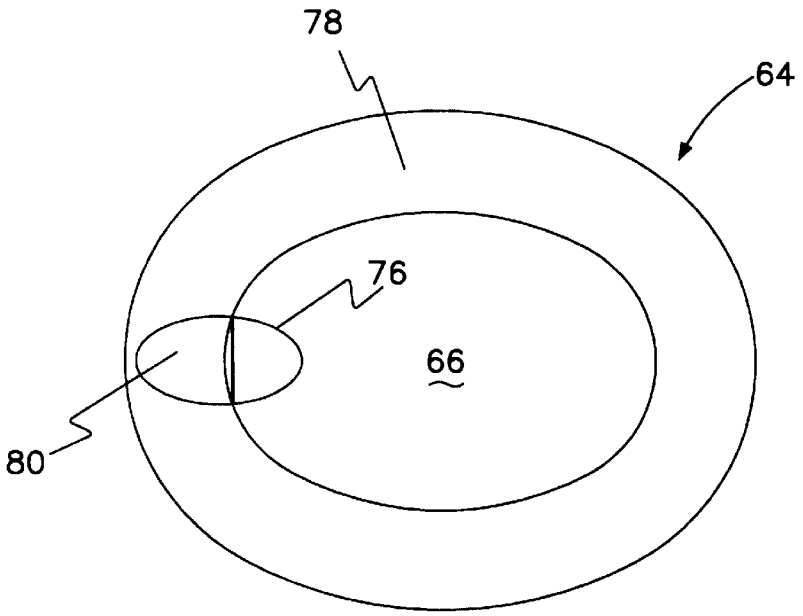
FIG. 3 is a plan view of a seat portion, taken along line 3—3 of FIG. 1.

A plan view of the liner 58 is shown in FIG. 2 as including a thin hydrophobic sheet 60 of water proof material, which will hold and contain any liquids. Preferably, the hydrophobic sheet is a plastic film made of any suitable material. Attached to the center of the plastic sheet 60 is a pad 62 of hydrophilic material which soaks up a relatively large amount of liquid. Both the plastic film and the hydrophilic pad are well known materials, examples of which are found in disposable diapers, grocery bags, various drainage pads and the like.

To install the liner, the lid 20 is separated from the center section 44. The inner door 32 is opened and a fresh liner is removed from the space 38. The plastic sheet 60 is spread over a seat 64 resting on the top of the inner container 44. The pad 62 is pushed downwardly into the open space 66 in the seat. The plastic sheet 60 is pulled over the two snap coupling beads 50 and 52 as the center section 40 is snapped into the base unit 22. Preferably the hydrophobic sheet 60 has a cut section 70 leading to an opening 72 which fits over the handle 46 on the center section. The plastic sheet 60 is, thus, captured between the snap coupler recess 26 on the base unit 22 and the snap coupler bead 52 on the center section, thereby clamping the hydrophobic sheet into position and removably securing it to the top of the cup shaped base unit 22.

The disposal of the spent liner is essentially the same as a disposal of a disposable diaper. However, the base unit 22 may be provided with enough space in the area 68 to receive a spent liner. To facilitate storage in such a manner twist ties, zipper plastic bags or the like may be provided.

Figure 4:
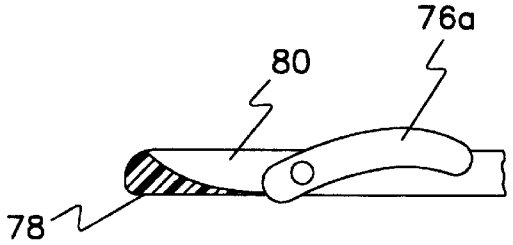
FIG. 4 is a fragment of FIG. 3 in cross section showing a splash guard in a storage position.
Figure 5:
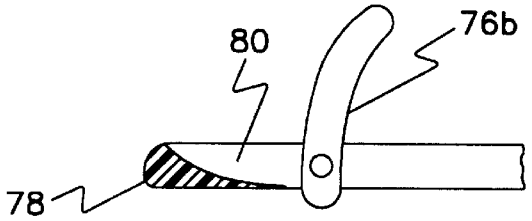
FIG. 5 is the same as FIG. 4 with the splash guard in an elevated position.
Figure 6:
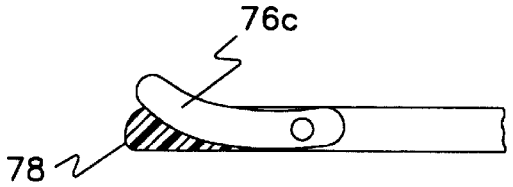
FIG. 6 is the same as FIG. 4 with the splash guard folded forward in an out of the way position.

Optionally a splash guard 76 may be hinged to the seat at the front of the opening 66. As shown at 76*a* in FIG. 4, during storage the splash guard may fold to a low profile position so that it will fit under the lid 28. In use, the splash guard may be raised to a first click stop, as shown at 76*b*. The splash guard may also be moved to a second click stop 76*c* where it is out of the way. Optionally only the two positions 76*b* and 76*c* may be provided. The seat 78 is preferably a molded plastic member with a recess 80 which gives enough clearance for the splash guard to rest in the out of the way position 76*c*.

To make the entire unit very compact, the storage spaces 38 and 68 maybe eliminated. The entire base unit 22 may also be eliminated leaving only the lid 28 and center section 44. Hence, essentially the same molded parts may be used to make a variety of devices ranging from a compact to a relatively complete self contained unit.

Those who are skilled in the art will readily perceive various modifications and substitutions which fall with in the scope and spirit of the invention; therefore, the appended claims are to be construed to include all equivalent The claimed invention is:

1. A portable toilet comprising three separate molded plastic pieces forming a container set which may be snapped together to form a compact closed container, said set including a base unit, a center unit and a lid unit which cooperate to form said close container when snapped together, each of said base unit and said center unit forming a cup shaped member with a closed bottom surface and an open top, said base unit and said center unit nesting and snapping together with a secure relationship with the bottom of said center unit nested within the open top of said base unit, a liner comprising a hydrophobic film with a hydrophilic drainage pad in the center thereof, said liner having dimensions and contours which fit into said cup shaped center unit and which lays over and is trapped between a rim of said center unit and said base unit when they are snapped together.

2. The toilet of claim 1 and a splash deflector attached to the front of a seat associated with said center unit, said deflector being movable from a storage position to a use position.

3. The toilet of claim 1 further comprising means within the three piece container for storing spend liners.

4. The toilet of claim 1 and a splash deflector attached to the front of the seat, said deflector being movable from a storage position to a use position.

5. The toilet of claim 4 wherein said splash deflector has a third position which is out of the way during use.

6. A portable toilet having a number of separate molded parts which may be nested and are then securely interlocked by being snapped together to form a compact closed container; said container comprising a cup shaped base; a cup shaped center unit; and a lid unit, a mating bead and depression surrounding said individual one of said parts to form a snap coupler to enable said snapping together; said base unit, center unit, and lid unit fitting together to form a closed snap together container, a liner comprising a hydrophobic sheet having an absorbing hydrophilic pad centrally attached thereto, said liner having a shape and proportions that enable said sheet to completely cover at least the top of said cup shaped center unit and to fit down and into the interior of the cup shape with said hydrophilic pad in the bottom of the cup shaped unit, and said hydrophilic sheet being removably secured to the top of said cup shaped center unit by being trapped between said base and said center unit.

7. The toilet of claim 6 wherein the shape and proportions of the hydrophobic sheet goes over the top of the seat thereby preserving the cleanliness of the seat during the use thereof.

8. The toilet of claim 7 wherein said portable toilet further comprises means on said base unit for receiving, supporting, and capturing the cup shaped unit, and means on said lid for covering and capturing the top of said cup shaped unit, thereby completely and securely enclosing the child's toilet into a portable unit when not in use.

9. The toilet of claim 8 wherein the parts further comprise at least said lid, said cup shaped unit, and the base unit, said lid, said cup shaped unit, and said base unit being shaped to releasably snap together.

10. The toilet of claim 9 wherein the shape which enables the lid, cup shaped unit, and base unit to snap together comprises a peripheral snap coupler recess in some parts and a mating peripheral snap coupler ridge on other of the parts.

11. The toilet of claim 10 and a splash guard attached to the front of the said seat, said splash guard being movable between a storage position and a use position.

* * * * *